US008601948B2

(12) United States Patent
Spring

(10) Patent No.: US 8,601,948 B2
(45) Date of Patent: Dec. 10, 2013

(54) SPARK GAP ISOLATED, RF SAFE, PRIMARY EXPLOSIVE DETONATOR FOR DOWNHOLE APPLICATIONS

(75) Inventor: Christian C. Spring, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/093,560

(22) Filed: Apr. 25, 2011

(65) Prior Publication Data

US 2012/0186476 A1 Jul. 26, 2012

Related U.S. Application Data

(60) Provisional application No. 61/328,007, filed on Apr. 26, 2010.

(51) Int. Cl.
*F42B 3/182* (2006.01)
*F42B 3/188* (2006.01)

(52) U.S. Cl.
USPC ..... 102/202.2; 102/202.3

(58) Field of Classification Search
USPC ..... 102/202.1, 202.2, 202.3, 202.4, 202.5, 102/202.8, 202.11
See application file for complete search history.

(56) References Cited

U.S. PATENT DOCUMENTS

| | | | | |
|---|---|---|---|---|
| 3,804,018 | A * | 4/1974 | Janoski | 102/202.4 |
| 3,906,273 | A | 9/1975 | Kozlowski | |
| 4,869,170 | A | 9/1989 | Dahmberg et al. | |
| 5,036,768 | A | 8/1991 | Dow et al. | |
| 5,505,134 | A | 4/1996 | Brooks | |
| 6,385,031 | B1 | 5/2002 | Lerche | |
| 6,386,108 | B1 | 5/2002 | Brooks | |
| 6,739,264 | B1 | 5/2004 | Hosey et al. | |
| 6,752,083 | B1 | 6/2004 | Lerche | |
| 7,007,756 | B2 | 3/2006 | Lerche | |
| 7,336,474 | B2 | 2/2008 | Lerche | |
| 7,624,681 | B2 | 12/2009 | Goodman | |
| 7,874,250 | B2 | 1/2011 | Veneruso | |
| 2004/0160726 | A1 | 8/2004 | Lerche | |
| 2005/0178282 | A1 | 8/2005 | Brooks | |
| 2006/0249045 | A1 | 11/2006 | Goodman | |
| 2010/0229749 | A1 | 9/2010 | Veneruso | |

FOREIGN PATENT DOCUMENTS

| | | | |
|---|---|---|---|
| EP | 0679859 | A2 | 11/1995 |
| WO | 0020820 | A2 | 4/2000 |
| WO | 0020820 | A3 | 4/2000 |
| WO | 0020820 | A9 | 4/2000 |
| WO | 0022279 | A1 | 4/2000 |

OTHER PUBLICATIONS

International Search Report and Written Opinion of PCT Application No. PCT/US2011/033946 dated Feb. 8, 2012.

* cited by examiner

*Primary Examiner* — James Bergin
(74) *Attorney, Agent, or Firm* — Jeffery R. Peterson; Brandon Clark

(57) ABSTRACT

An radio frequency (RF) safe, high standoff voltage, ESD protected primary explosive detonator is described. The primary explosive detonator includes an isolated spark gap (SG) circuit and one or more shunt capacitors to insulate the electric match from ignition when exposure to high stray voltage or RF occurs in oilfield applications.

14 Claims, 3 Drawing Sheets

SPARK GAP ISOLATED, RF SAFE, PRIMARY EXPLOSIVE DETONATOR FOR DOWNHOLE APPLICATIONS

CROSS REFERENCE TO RELATED APPLICATIONS

This application claims benefit of Provisional Application Ser. No. 61/328,007, filed on Apr. 26, 2010. This provisional application is incorporated by reference in its entirety.

TECHNICAL FIELD

The present application relates to detonators, and more specifically to RF safe detonators for use in connection with perforating technology in oilfield applications.

BACKGROUND

A primary explosive is an explosive that is extremely sensitive to stimuli such as impact, friction, heat, static electricity, radio frequency, or electromagnetic radiation. A relatively small amount of energy is required for initiation of a primary explosive. Generally, primary explosives are considered to be those compounds that are more sensitive than Pentaerythritol tetranitrate (PETN). Primary explosives are often used in detonators or to trigger larger charges of less sensitive secondary explosives. For example, in the oil and gas industry, more standard primary explosive detonators are used than any other detonator types. Such detonators are typically used in connection with perforating technology to blast holes into steel pipes downhole.

FIG. 1 shows a conventional primary explosive (1) ohm detonator. The oil industry prefers using resistorized primary explosive detonators requiring resistors in each lead of the 1 Ohm detonator (not shown in FIG. 1). The primary explosive detonator typically uses a one (1) Ohm electric match with an ignition mixture coating (100). Electric current is passed through the match causing Joule heating that in turn causes the ignition mixture (100) to ignite. The ignition mixture (100) causes the Lead Styphnate (102) to detonate, which in turn causes the Lead Azide (104) to detonate, resulting in the final explosive powder Research Department Explosive/High Melting Explosive (RDX/HMX) or Hexanitrostilbene (HNS) (106) to detonate. The ignition mixture (100), Lead Styphante (102), and Lead Azide (104) are classified as primary explosives, while RDX, HMX or HNS (106) are classified as secondary explosives. The sensitivity of each chemical is in decreasing order from electric match, primary explosive, and then to secondary explosive.

Because primary explosive detonators are very sensitive to stray voltage exposure, electrostatic discharge (ESD), and radio frequency (RF), they can often easily be triggered to explode, causing unsafe environments in an oil and gas setting. For example, it would not take much more than 1 volt of stray voltage exposure to trigger detonation of the primary explosive detonator shown in FIG. 1. The typical no-fire for a fuse such as that shown in FIG. 1 is 200 mA, while all-fire is specified as 800 mA. With a 1 ohm electric match, it takes approximately only 0.2V across the match to reach 200 mA no-fire current and only 0.8V across the match to reach 800 mA all-fire.

As an alternative, Exploding Bridge Wire (EBW) and Exploding Foil Initiator (EFI) detonators are highly resistant to ESD, RF, and stray voltage exposure. EBW and EFI are more expensive to manufacture, and because of the cost, these detonators are mostly used in high tier oil industry applications.

Accordingly, what is needed is primary explosive detonator safer under exposure to RF and stray voltage which does not greatly increase the cost to implement.

SUMMARY

In general, in one aspect, the invention relates to a primary explosive detonator circuit, comprising a first spark gap circuit configured to provide stray voltage standoff for the primary explosive detonator, at least one first shunt capacitor, wherein the combination of the first spark gap circuit and the at least one first shunt capacitor provides protection from radio frequency (RF) exposure of the primary explosive detonator circuit, an electric match, and a detonation explosive, wherein the electric match ignites to trigger the detonation explosive.

Other aspects of the invention will be apparent from the following description and the appended claims.

DETAILED DESCRIPTION

Figure 1:
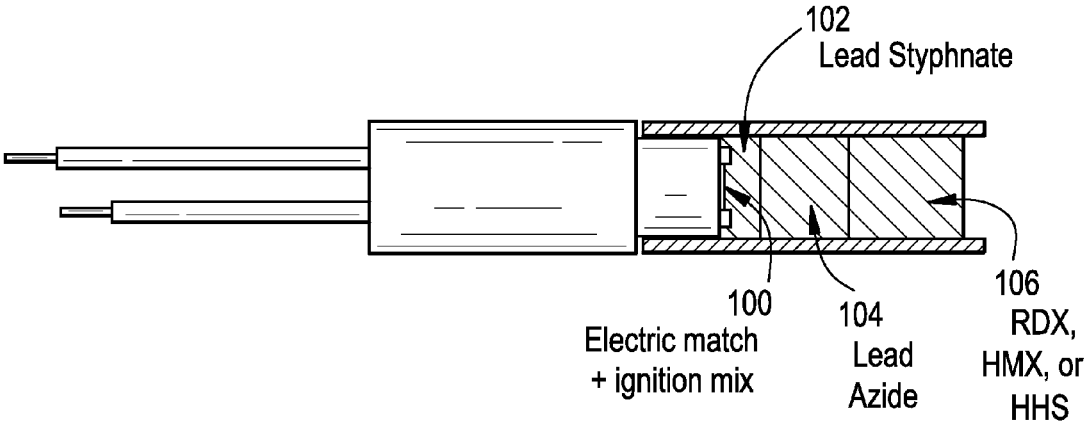
FIG. 1 (PRIOR ART)
FIG. 1 shows a conventional primary explosive detonator.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention present an RF safe, high standoff voltage, ESD protected, primary explosive detonator. More specifically, embodiments of the invention provide a primary explosive detonator which implements a spark gap circuit. An offshore rig may use active cathodic protection that can cause potential differences on the rig as high as 45 Vdc. In addition to stray voltage, RF susceptibly is always an issue. Cell phones, ship board weather, traffic and military radar are sources of stray high intensity RF energy. Stray voltage and RF protection is usually under addressed either because of misunderstanding or cost consideration. These and other conditions, such as proximity to transmitters or other sources of RF and stray voltage exposure, necessitate a cost-effective electric match fuse that is less sensitive to such stimuli.

Figure 2:
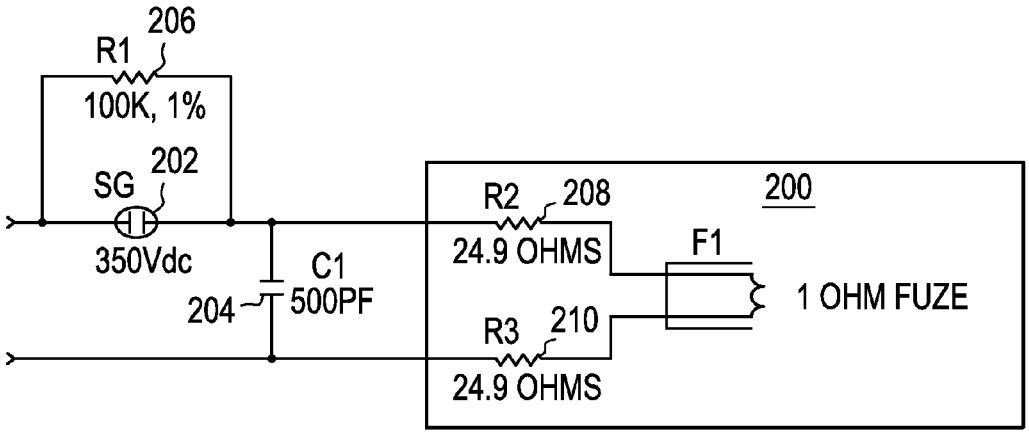
FIG. 2 shows a resistorized detonator circuit in accordance with one or more embodiments of the invention.

FIG. 2 shows a resistorized detonator circuit with a spark gap circuit in accordance with one or more embodiments of the invention. In one or more embodiments of the invention, a spark gap circuit (also known as a gas tube) may be an arrangement of two conducting electrodes separated by a gap usually filled with a gas such as air, designed to allow an electric spark to pass between the conductors. When the voltage difference between the conductors exceeds the gap's breakdown voltage, a spark forms, ionizing the gas and drastically reducing its electrical resistance. An electric current then flows until the path of ionized gas is broken or the current reduces below a minimum value called the 'holding current'. This usually happens when the voltage drops, but in some cases occurs when the heated gas rises, stretching out and then breaking the filament of ionized gas.

Turning to FIG. 2, in one or more embodiments of the invention, a primary explosive detonator may include resistors (208, 210) in each lead in series with the 1 Ohm electric match to reduce sensitivity. For example, two resistors between 25 and 30 Ohms connected to each leg of the fuse in series with the 1 Ohm electric match may be used to reduce sensitivity to stray voltage exposure. The primary explosive detonator resistance can be 50-70 Ohms. For example, FIG. 2 shows two resistors R1 (208) and R2 (210) that are 24.9 Ohms each in series connection with F1 (the fuse or 1 Ohm electrical match (200)). In this case, for example, the voltage required to reach the no-fire limit of 200 mA has increased to approximately 10.6V while all-fire has increased to approximately 40.6V. Hereafter, the combination of 200, 208, and 210 is referred to as a 'resistorized detonator circuit.'

In one or more embodiments of the invention, a spark gap circuit SG (202) is connected in series with one lead of the resistorized detonator circuit (200). For example, as shown in FIG. 2, the SG (202) may have a value of 350 Vdc. Further, a capacitor C1 (204) is connected in series with the SG (202) and in parallel with the resistorized detonator circuit (200). Each of the aforementioned circuit components of FIG. 2 are explained in detail below.

In one or more embodiments of the invention, the SG (202) is a protection circuit placed between the lead wires and electric match. More specifically, the SG (202) provides high voltage stand-off (i.e., acts as an insulator) until the gas in the spark gap circuit (202) becomes ionized, making it that much harder to ignite the fuse F1. With a 350 Vdc SG, 350 volts is required to across the SG leads before the gas is ionized. When the gas is ionized, the voltage drop across the tube drops from 350 Vdc to less than 12 Vdc. Accordingly, addition of the spark gap circuit to the resistorized detonator circuit raises the threshold that needs to be reached before stray voltage exposure and/or RF exposure triggers detonation of the fuse F1. The amount by which the threshold is raised depends on the voltage required to ionize the gas in the spark gap circuit. Gases that may be used in the spark gap circuit include, but are not limited to, nitrogen, helium, argon, neon, and/or any combination thereof. The spark gap (202) and the capacitor (204) are relatively inexpensive add-ons to the resistorized detonator circuit.

Capacitor C1 (204) may be placed in series with SG (202) and in parallel with the resistorized detonator circuit to help in conditions of high frequency (RF) exposure in oilfield applications or downhole applications. C1 (204) acts as a high frequency shunt. More specifically, in one or more embodiments, SG (202) combined with capacitor C1 (204) forms an AC voltage divider that shunts any RF away from the electric match. Accordingly, the capacitance provides RF protection for the fuse F1. C1 may have a value of, for example, 270 Pico farads (pF) or greater, preferably around 500 pF. Those skilled in the art will appreciate that the value of C1 is selected to provide the appropriate attenuation desired. As shown in FIG. 2, for example, a 500 pF capacitor added with the spark gap circuit forms an attenuation ratio of 1 to 500. At high frequencies (assuming the impedance of the resistorized detonator circuit is large compared to the impedance Z of C1 (204), given by $Z=1/(2\pi f C)$, where f is the frequency of the stray high frequency signal) any induced voltage due to RF exposure is shared among the series combination of the spark gap SG (202) and C1 (204). Thus, if the capacitance of C1 (204) is 500 times the capacitance of SG (202), as shown in FIG. 2, the voltage drop across C1 (204), and, thus, also the voltage drop across the fuse F1, is 1/500 of the voltage drop across SG (202). Such an arrangement may further protect fuse F1 from an inadvertent ignition induced by high frequency (RF) exposure.

The resistor R1 (206) may have a value of 100K and is used for testing purposes to ensure that the fuse F1 is present, i.e., that a connection of the fuse F1 is present downhole. When the fuse is open, e.g., the fuse wire is damaged, there is no connection to the detonator. However, because a spark gap circuit is an open circuit, the spark gap circuit cannot be used to send a trickle current through to measure whether the fuse F1 connection exists. With the addition of R1 (206) across the spark gap circuit (202) (i.e., arranged in parallel with SG (202), the trickle current, e.g., less than 1 mA may be passed through the resistor R1 (206) to test whether the fuse connection exists using a safety meter. Accordingly, R1 (206) allows for such testability before placing the protection circuit downhole.

Figure 3:
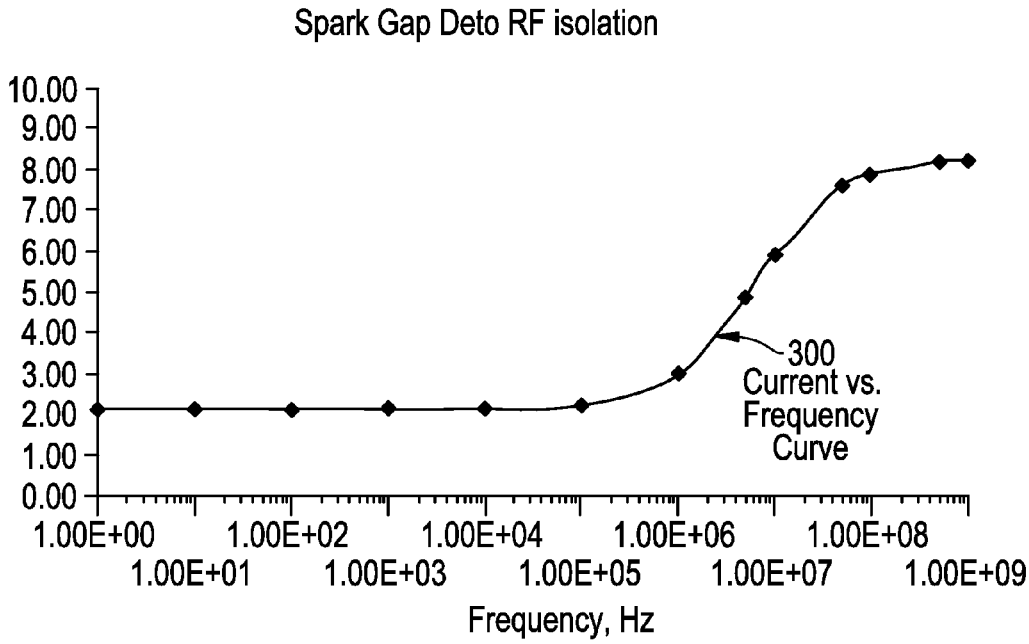
FIG. 3 shows a current vs. frequency curve in accordance with one or more embodiments of the invention.

Those skilled in the art will appreciate that FIG. 3 may be arranged in alternate forms to that which is shown or described above. For example, capacitor C1 is not limited to being arranged in series with the spark gap circuit, and may be placed, in one or more embodiments, in parallel with the spark gap circuit. Similarly, resistor R1 limited to being in parallel with the spark gap circuit.

To initiate the detonator with input spark gaps, the spark gaps must be ionized before current can be passed to the electric match. In the circuit of FIG. 2, for example, the initiation could take place using 400 Vdc with current limit set to 1 A. The voltage may then be ramped-up as fast as possible and held for at least 5 seconds, which initiates the detonator.

Those skilled in the art will appreciate that any reasonable value for the spark gap SG may be implemented, and that the SG is not limited to 350 Vdc. For example, SG (202) may be a 200 Volt spark gap circuit. In this case, 200 Volts is required across the electrodes of the spark gap circuit before the gas becomes ionized. Those skilled in the art will further appreciate that FIG. 2 may, in one or more embodiments described herein, be implemented without one or more of the resistors R1, R2 and R3. For example, the protection circuit may simply be the fuse F1 combined with a spark gap SG circuit, and a capacitor. Alternatively, the protection circuit may include R2 and R3 as shown in FIG. 2, but may omit R1 if a testing resistor is not necessary. Further, FIG. 2 may be implemented with a second shunt capacitor C2 (not shown) for redundancy.

FIG. 3 shows a graphed curve (300) illustrating induced current in the electric match vs. frequency of RF exposure corresponding to the modified resistorized detonator circuit of FIG. 2 in accordance with one or more embodiments of the invention. More specifically, FIG. 3 shows what happens to the current (in mA) flowing through the electric match when the detonator leads are exposed to 210 Vrms RF voltage from 1 Hz to 1 GHz. As can be seen in FIG. 3, the current remains constant at 2 mA until about 1 MHz, at which point the current begins to increase. At 1 GHz, the current is only 8 mA, however, showing that even if 210 Vrms RF voltage is injected into the protection circuit as configured in FIG. 2, there is not much current drawn. This illustrations the protection provided by the modified resistorized detonator circuit of FIG. 3 with respect to RF exposure.

Figure 4:
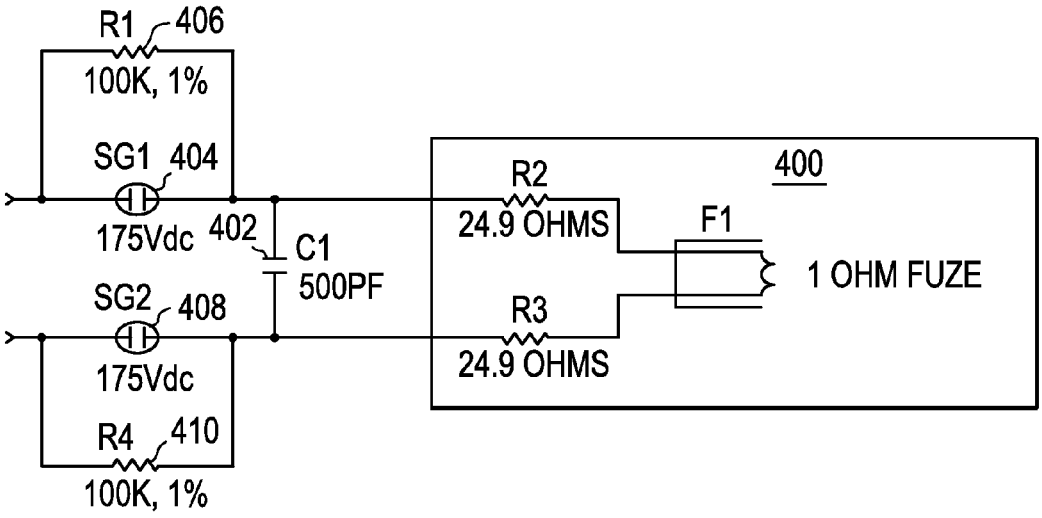
FIG. 4 shows a resistorized detonator circuit with a differential spark gap circuit in accordance with one or more embodiments of the invention.

FIG. 4 shows the modified resistorized detonator circuit of FIG. 2, with additional redundancy and fault tolerance. Specifically, FIG. 4 includes a second spark gap circuit SG2 (408) and resistor R4 (410) added to the resistorized detonator circuit (400) for redundancy purposes. Although not shown, there may also be an additional capacitor corresponding to SG2 (408) and R4 (410). Thus, with the implementation shown in FIG. 4, if the first spark gap circuit SG1 (404), resistor R1 (406), and capacitor C1 (402) combination short circuits or fails for any reason, another set of the same circuit components (408, 410) are implemented as a back-up. Those skilled in the art will appreciate that FIG. 4 operates in substantially the same manner as FIG. 2 described above. For example, spark gap SG1 and SG2 (404, 408) may provide stray voltage standoff of 300 Vdc. Spark Gap SG1 and SG2, along with shunt capacitors C1 and C2, form an AC voltage divider that shunts any RF away from the electric match. The spark gap capacitance is typically less than 1 pF while the shunt capacitors are at least 270 pF or greater. FIG. 4 may also be implemented, in one or more embodiments, with two C1 capacitors and two C2 capacitors, for redundancy.

Those skilled in the art will appreciate that the tolerance of the spark gap may be an issue depending on the type of spark gap selected, as there may be ±30% tolerance, making the minimum standoff 210 Vdc with no failures, and 105 Vdc with one failure.

Further, those skilled in the art will appreciate that implementation of the aforementioned improved detonator circuits may alter (e.g., lengthen) the dimensions of the circuitry and/or packaging required to implement the modified primary explosive detonator as described herein. For example, each spark gap circuit added to the design may be 0.06 inches. Thus, where a previous detonator device may be ¼ inch in diameter and 1 inch long, the detonator device as described herein may be 0.375 to ½ inch in diameter and 2 inches in length. Accordingly, the dimensions and packaging of the electric match fuse may be adjusted to accommodate the protection circuit that is implemented with the resistorized detonator circuit. In addition, although not described above, those skilled in the art will appreciate that ESD protection may also be provided in the form of printed circuit board pads to case or lead-wires to case spacing, but such ESD protection may be dependent on how the protection circuit (i.e., the isolated spark gap circuit described above in FIGS. 2-4) is placed in the aluminum tubing or packaging for the detonator.

Figure 5:
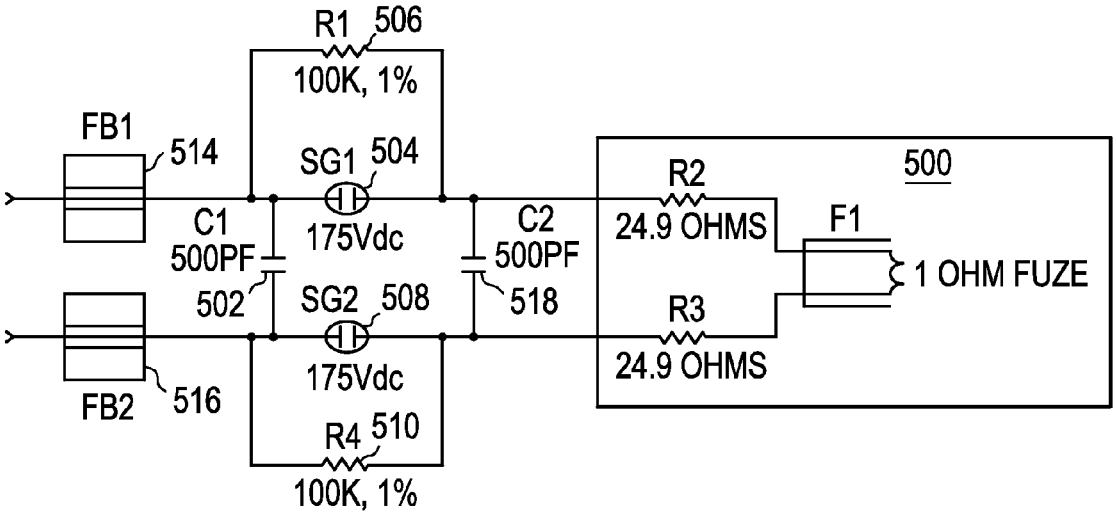
FIG. 5 shows a resistorized detonator circuit with a differential spark gap circuit and a ferrite bead in accordance with one or more embodiments of the invention.

FIG. 5 shows the modified resistorized detonator circuit of FIG. 5 (500-510), and additionally includes optional ferrite beads FB1, FB2 (514, 516) on each lead of the circuit. Ferrite beads are one-wire inductors (having impedance Z given by $Z=2\pi fL$, where f is the frequency of the stray high frequency signal), which may be implemented to provide additional RF protection. Adding capacitor C2 (518) also boosts RF attenuation further. Those skilled in the art will appreciate that the use of ferrite beads is optional, and that any other form of inductor may also be used. For example, many wire inductors may be used rather than a one-wire inductor. Further, there may be two C1 capacitors and two C2 capacitors for redundancy, although the configuration of FIG. 5 shows only one C1 and one C2.

In one or more embodiments of the invention, one or more of the primary explosive detonator circuit embodiments described herein may be implemented in a perforating device as used in downhole applications. Specifically, to complete a well, one or more formation zones adjacent a wellbore are perforated to allow fluids from the formation zones to flow into the wells for production to the surface or to allow injection fluids to be applied into the formation zones. Perforation in an oilfield environment is a procedure involving the use of explosive actuated perforating devices, or tools, which produce holes through the steel well casing and cement and into the formation. Perforating devices may utilize propellant-driven ballistic penetrators or jets formed from explosive shaped charges to produce paths of mass transport to and from the formation or reservoir.

In one or more embodiments, one such perforating device may be a perforating gun. In an example of a perforation operation using a perforating gun, a perforating gun string including one or more such guns may be lowered into the wellbore and the guns fired to create openings in the casing and to extend perforations into the surrounding formation. The perforating gun may be lowered into the wellbore using wireline, slickline, E-line, coil tubing, or a conventional drill string method. The perforating gun may include a housing, a firing head, and a loading tube with shape charges that are activatable to create perforation tunnels in a formation surrounding a wellbore interval and casing. Such a perforating gun may be activated by various mechanisms, such as by a signal communicated over an electrical conductor, a fiber optic line, a hydraulic control line, or other type of conduit.

In one or more embodiments of the invention, the firing head of the perforating gun may employ a primary explosive detonator circuit as described above in FIGS. 2-5. That is, a primary explosive detonator circuit as described above, including the spark gap circuit, one or more shunt capacitors, and one or more resistors, may be integrated with a perforating gun including steel tubes or metallic strips. Shaped charges connected by detonating cord may be inserted into the steel tubes or metallic strips, without means of initiation. In such an embodiment, the primary explosive detonator circuit described above may serve as the detonation means of the perforating gun.

Embodiments of the invention provide a spark gap isolated primary explosive detonator with substantial stray voltage standoff when compared to a standard primary explosive detonator. The combination of the spark gap and at least one RF bypass capacitor allows for the modified primary explosive detonator to be RF safe. Additionally, inductance such as a ferrite bead in each lead increases microwave frequency isolation. Addition of further shunt capacitors provides redundant protection. The modified resistorized detonator circuit described herein may be used in oilfield technology and specifically for downhole applications involving perforation of the steel pipe and within blasting caps. Further, the additional circuit components of the spark gap circuit, shunt capacitor and one or more resistors are inexpensive and efficient alternatives to the Exploding Bridge Wire (EBW) and Exploding Foil Initiator (EFI) detonators.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A primary explosive detonator circuit, comprising:

a first spark gap circuit coupled to a first lead of the detonator circuit configured to provide stray voltage standoff for the primary explosive detonator;

an electric match coupled to the first spark gap circuit having a first lead, a second lead, a first resistor arranged in series with the first lead of the electric match, and a second resistor arranged in series with the second lead of the electric match;

a detonation explosive positioned adjacent the electrical match opposite first spark gap circuit, wherein the electric match ignites to trigger the detonation explosive; and at least one first shunt capacitor in parallel with the electric match, the at least one shunt capacitor coupled to a second lead of the detonator circuit and to the first spark gap circuit, wherein the combination of the first spark gap circuit and the at least one first shunt capacitor provides protection from radio frequency (RE) exposure of the primary explosive detonator circuit.

2. The primary explosive detonator circuit of claim 1, wherein the first and second resistor are between 25 and 30 Ohms.

3. The primary explosive detonator circuit of claim 1, wherein the electric match is a one (1) Ohm resistor fuse.

4. The primary explosive detonator circuit of claim 1, wherein the first spark gap circuit comprises a gas in between two electrode leads, wherein the gas is at least one selected from a group consisting of neon, argon, helium, nitrogen, and air.

5. The primary explosive detonator circuit of claim 1, wherein the detonation explosive comprises at least one selected from a group consisting of Lead Styphate, Lead Azide, RDX, HMX, and HNS.

6. The primary explosive detonator circuit of claim 1, wherein the at least one first shunt capacitor is arranged in series with the first spark gap circuit and comprises a value of 500 Pico farads (pF).

7. The primary explosive detonator circuit of claim 1, further comprising:

at least one ferrite bead on each lead of the electric match, wherein the at least one ferrite bead adds inductance to the primary explosive detonator circuit and is configured to provide additional RF protection.

8. The primary explosive detonator circuit of claim 1, further comprising:

a second spark gap circuit coupled to the second lead of the detonator circuit; and at least one second shunt capacitor coupled in parallel with the first shunt capacitor, wherein the combination of the second spark gap circuit and the at least one second shunt capacitor provides redundant protection from RF explosive of the primary explosive detonator circuit.

9. The primary explosive detonator circuit of claim 8, wherein the first and second spark gap circuits are in the range of 175Vdc-350Vdc spark gap circuits.

10. The primary explosive detonator circuit of claim 8, wherein the first spark gap circuit is arranged on the first lead of the detonator circuit, and the second spark gap circuit is arranged on the second lead of the detonator circuit.

11. The primary explosive detonator circuit of claim 1, further comprising:

a test resistor arranged in parallel with the first spark gap circuit, wherein the test resistor allows a user to test the electric match using a safety meter.

12. The primary explosive detonator circuit of claim 11, wherein the test resistor is 100K Ohms.

13. The primary explosive detonator circuit of claim 1, wherein the primary explosive detonator circuit is used in downhole applications involving perforation of a downhole pipe.

14. The primary explosive detonator circuit of claim 1, wherein the primary explosive detonator circuit is implemented in a firing head of a perforating device.

* * * * *